US007081099B1

(12) United States Patent
Luo

(10) Patent No.: US 7,081,099 B1
(45) Date of Patent: Jul. 25, 2006

(54) MASSAGER FOOTREST

(75) Inventor: Lili Luo, Dipu Town (CN)

(73) Assignee: American Lighting Industry, Inc., Riverside, CA (US)

( * ) Notice: Subject to any disclaimer, the term of this patent is extended or adjusted under 35 U.S.C. 154(b) by 0 days.

(21) Appl. No.: 11/325,966

(22) Filed: Jan. 4, 2006

(51) Int. Cl.
*A61H 15/00* (2006.01)

(52) U.S. Cl. ..... 601/86; 601/87; 601/103; 601/112; 601/134

(58) Field of Classification Search ..... 601/24, 601/26, 46, 85–87, 89–91, 93–95, 100–104, 601/134
See application file for complete search history.

(56) References Cited

U.S. PATENT DOCUMENTS 4,785,798 A * 11/1988 Yamasaki ..... 601/87
5,063,911 A * 11/1991 Teranishi ..... 601/46
5,183,034 A * 2/1993 Yamasaki et al. ..... 601/70
6,494,849 B1 * 12/2002 Kuo ..... 601/27
2001/0004679 A1 * 6/2001 Ichikawa ..... 601/98
2003/0199796 A1 * 10/2003 Yamazaki et al. ..... 601/87
2005/0124921 A1 * 6/2005 Tseng ..... 601/86
2005/0234371 A1 * 10/2005 Kurata et al. ..... 601/34

* cited by examiner

*Primary Examiner*—Danton Demille
*Assistant Examiner*—Manuj Agarwal
(74) *Attorney, Agent, or Firm*—Law Offices of S.J. Christine Yang

(57) ABSTRACT

A foot massage unit has a four-head unit with a center common drive electric motor. The unit includes two symmetrically shaped gear cases. The first gear case comprises a symmetrical pair of gear housings in the shape of a twin disc having a bottom case and a top case and is positioned proximally to one of two power outputs of the motor. At the opposite side of the motor is positioned the second gear case comprising a symmetrical pair of gear housings of a bottom case and a top case. The driving shaft of the motor extends in opposite directions and is provided with two concentric worms. Externally of the gear cases are four rotating massage heads fixed to the corresponding shafts. Each head has a plate and a semispherical shaft bore formed in the plate, and two pressure balls at the farther opposite tips of the elongated plate.

6 Claims, 4 Drawing Sheets

MASSAGER FOOTREST

BACKGROUND OF THE INVENTION

A. Field of the Invention

The present invention relates to a massager. More particularly the present invention relates to a detachable footrest massager for use with a massage chair.

B. Description of the Prior Art

Massage chairs are generally known to have in their seatbacks internal massage heads rotationally driven by their respective motors to effect mechanical rolling, kneading and tapping actions in an attempt to simulate what is performed by the human massagists.

As FIG. 9 of U.S. Pat. No. 6,629,940 exemplifies, leg-massaging footrests are known to resemble ottoman furniture with raised pressure walls moving toward and away from the sides of the legs of the user to stimulate the same sides of the legs sequentially lengthwise. Such conventional footrests are generally characterized by their distinctive massaging mechanism apart from the massage units in the massage chair on which the footrest is based. Those massaging mechanisms have been confined to exert lateral pressures directed to the left and right sides of the legs and couldn't help but designed irrespectively of the chair massaging systems where multiple rotating heads provide substantially perpendicular pressures to the relatively flat body areas like upper and lower backs. This individual approach to the body sections doubles the complexity of the otherwise simple process of delivering a competitive but affordable massaging benefit to the general public.

In view of the foregoing deficiency of the prior art chair massagers, an object of the present invention is to provide a unified massaging mechanism throughout the chair/footrest massage system to minimize the cost of manufacturing and subsequently maintaining such system while effecting the same quality massaging performance of the prior art devices.

Another object of the present invention is to provide a footrest massager utilizing the same design of components of the massaging units for the seatback while effecting a multi-directional massage pressure of lateral as well as perpendicular elements to the legs, calves and/or feet from under thereof.

SUMMARY OF THE INVENTION

The foot massage unit of the present invention utilizes the same mechanism as the back massage unit in order to simplify the construction of the massage chair by unifying the movements of massaging heads rather than diversifying them for different body parts as exemplified above by the prior art.

The foot massage unit is structured as a four-head unit with a common drive electric motor in the center. The foot massage unit also includes two symmetrically shaped gear cases. The first gear case comprises a symmetrical pair of gear housings in the shape of a twin disc having a bottom case and a top case and is positioned proximally to one of two power outputs of the motor. At the opposite side of the motor is positioned the second gear case comprising a symmetrical pair of gear housings of a bottom case and a top case. The first pair of top and bottom cases and the similar second pairs are secured by four or more screws running through the rims of the gear cases, respectively.

The footrest is shaped so that an upper shell has three ridges and two grooves in which sections of both legs may rest. Foam or other similar material of padding is provided with the conforming upper profile and fitted into the upper shell. The bottom side of the padding is shaped to hold the foot massage unit at its outer edges in a tight fit. The assembled foot massage unit is first framed in a metal bracket using an appropriate fastening means such as four sets of nuts and bolts through bolt holes formed at the outer rims of the gear cases. Then, the whole framed massage unit is attached to a bottom cover/bracket assembly, which is in turn affixed to the bottom end of the shell.

The bottom cover/bracket also has at its upper opposite ends a hinge means by which an attachment stay at the side of the chair frame is disposed in a pivotal engagement therebetween by a threading rod. The pivotal adjustment of the angle of extension of the footrest relative to the bottom of the seat may be locked at a corner bracket welded to the frame. The bracket has two arms with transverse holes, which can be registered with a latching means fixed to the corresponding section in the side of the frame.

The gear cases are respectively attached to the frame at the fastening means and hold each side of the intermediate motor at its upright rim sections. The motor operates to simultaneously drive four massaging heads. The driving shaft of the motor extends in opposite directions and is provided with two concentric worms. The first worm is in simultaneous mesh with two opposite side worm gears, which are centered about the respective shafts held upright by the bottom and top cases while the second worm is in mesh with another set of worm gears centered about the respective shafts. The worms and warm gears are all enclosed by the bottom and top gear cases. Externally of the gear cases are four rotating massage heads fixed to the corresponding shafts. The four massage heads are identical. Each head comprises a diamond shaped elongated plat, a semispherical shaft bore formed in the center of the plate, and two pressure balls at the farther opposite tips of the elongated plate. The worms and gears are meshed so that the gears in a set within a gear case rotate in opposite directions without interference, as will do the attached massage heads.

Embodiments of the invention will now be described by way of example with reference to the accompanying drawings.

DETAILED DESCRIPTION OF THE PREFERRED EMBODIMENT

Figure 1:
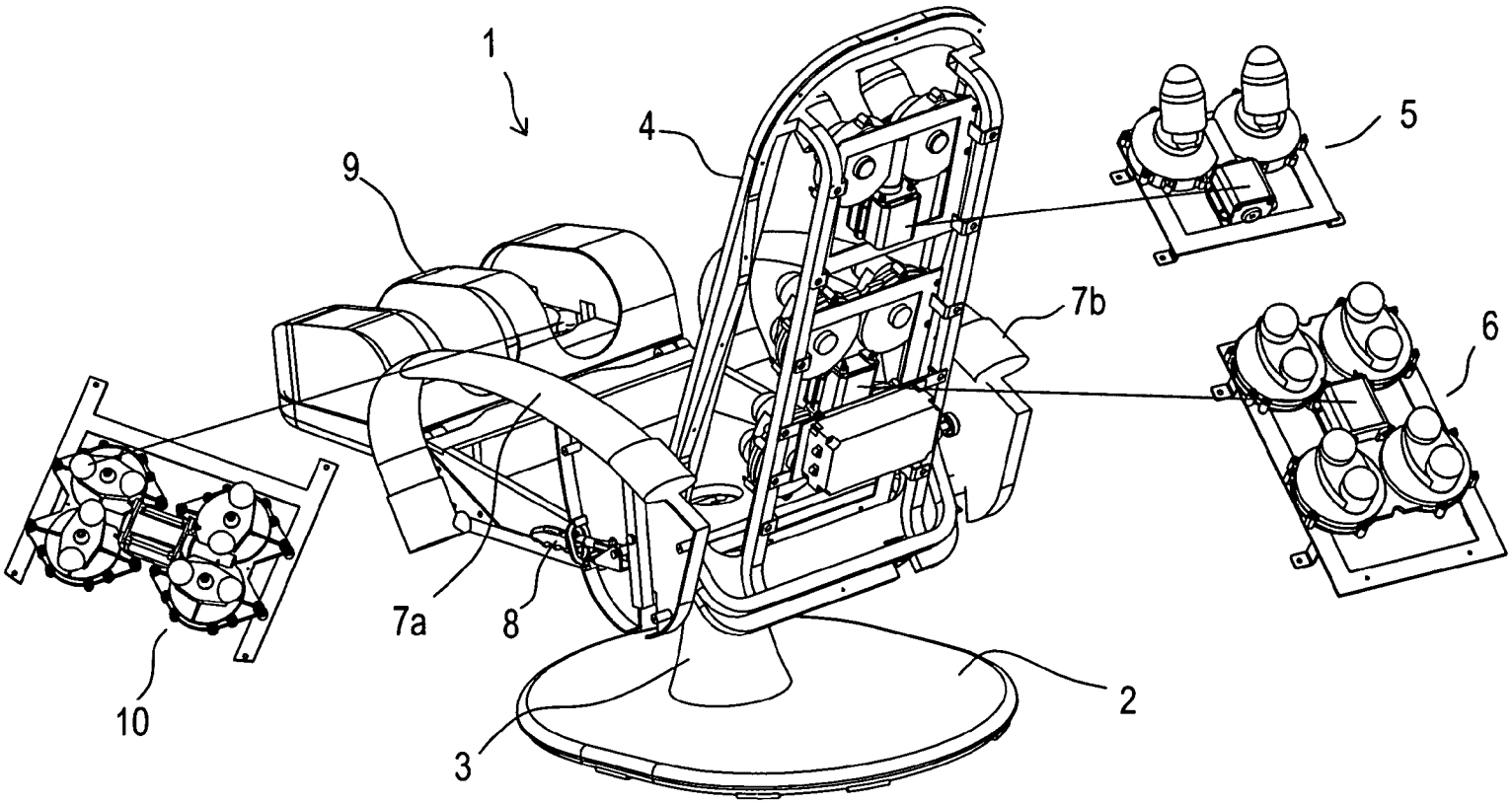
FIG. 1 is a perspective view of a massage chair according to the present invention.

FIG. 1 shows the general structure of a massage chair 1 according to the present invention before it is padded and upholstered. The massage chair 1 is shown to comprise an oval base 2 with an upright support 3, a foldable frame 4 for encasing a neck unit 5 and a back massage unit 6 and a cushion padding (not shown) to form a seat bottom and a seat back, a pair of side arm rests 7*a*/7*b* with a lever handle 8 for reclining the seat back of the frame 4 to a desired position and a footrest 9, which is equipped with a foot/calf massage unit 10 unique to the present invention and is hinged to the front end of the frame 4. The reclining seat back support is adjustable with automatic function to return to the upright position.

The foot massage unit 10 utilizes the same mechanism as the back massage unit 6 according to the present invention in order to simplify the construction of the massage chair by unifying the movements of massaging heads rather than diversifying them for different body parts as exemplified above by the prior art.

Figure 2:
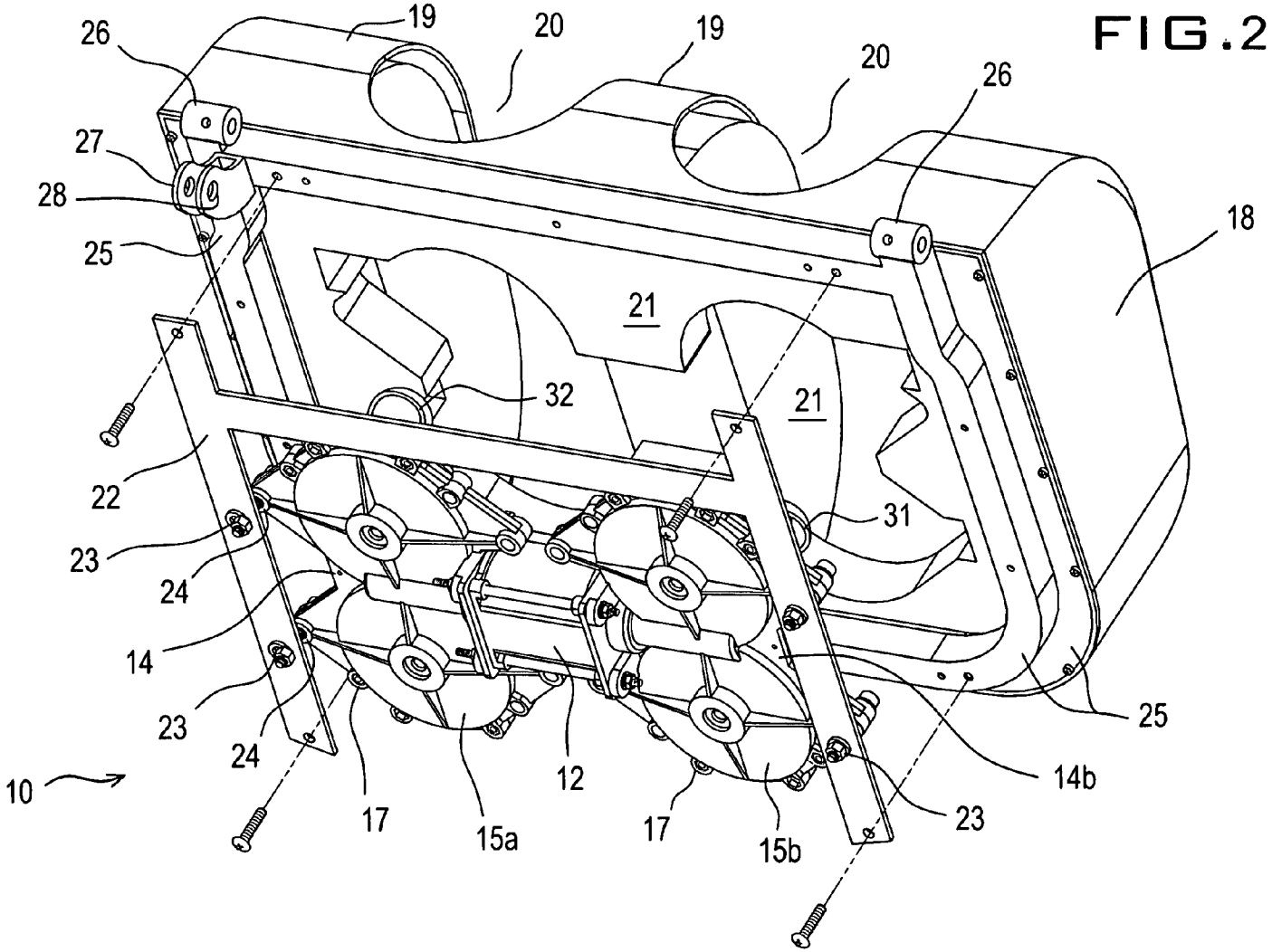
FIG. 2 is an exploded perspective view of the rear of the footrest utilizing the massaging unit according to the invention.
Figure 3:
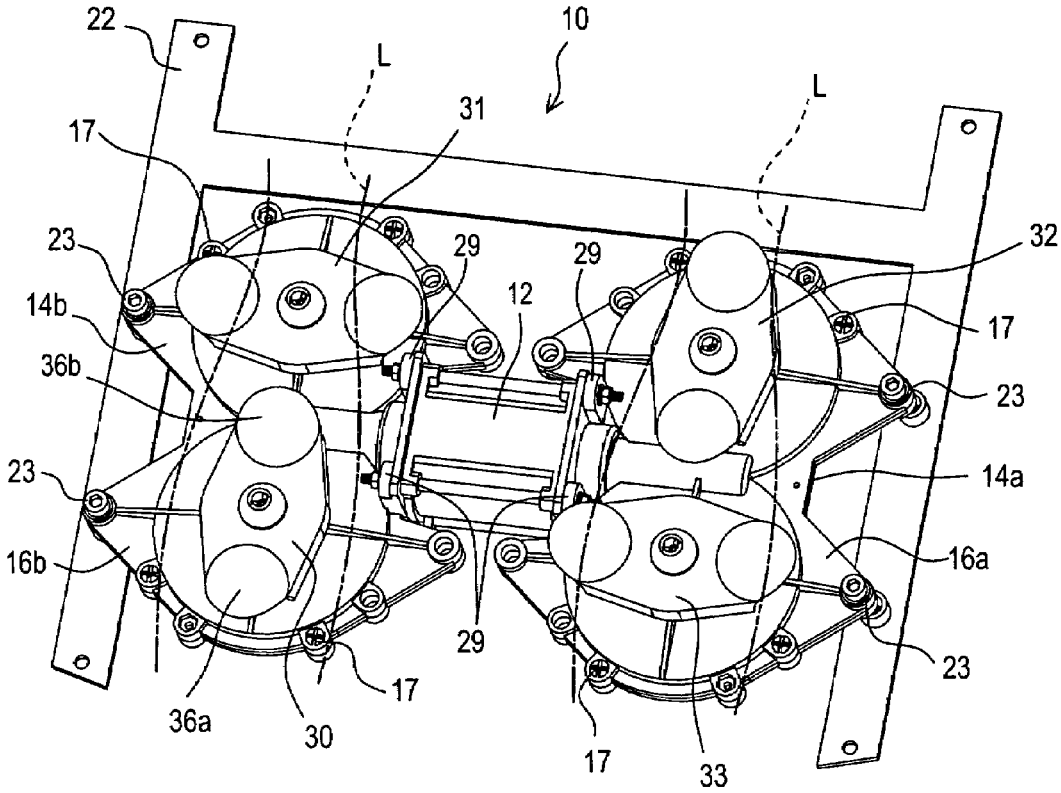
FIG. 3 is a front perspective view of the massaging unit of FIG. 2 showing its operation under user's legs.

As shown in FIGS. 2 and 3, the foot massage unit 10 is a four head unit with a common drive electric motor 12 in the center. The foot massage unit 10 also includes symmetrically shaped gear cases 14*a* and 14*b*. The gear case 14*a* comprises a symmetrical pair of gear housings in the shape of a twin disc having a bottom case 15*a* and a top case 16*a* and is positioned proximally to one of two power outputs of the motor 12. At the opposite side of the motor 12 is positioned the gear case 14*b* comprising a symmetrical pair of gear housings of a bottom case 15*b* and a top case 16*b*. The first pair of top and bottom cases 15*a* and 16*a* and the similar second pair 15*b* and 16*b* are secured by four or more screws 17 running through the rims of the gear cases 14*a* and 14*b*, respectively.

The footrest 9 is in a conventional design that an upper shell 18 has three ridges 19 and two grooves 20 in which sections of both legs may rest. Foam or other similar material of padding 21 is provided with the conforming upper profile and fitted into the upper shell 18. The bottom side of the padding 21 is shaped to hold the foot massage unit 10 at its outer edges in a tight fit. The assembled foot massage unit 10 is first framed in a metal bracket 22 using an appropriate fastening means 23 such as four sets of nuts and bolts through bolt holes 24 formed at the outer rims of the gear cases 14*a* and 14*b*. Then, the whole frame 10/22 is attached to a bottom cover/bracket assembly 25, which is in turn affixed to the bottom end of the shell 18.

The bracket 25 also has at its upper opposite ends a hinge means 26 by which an attachment stay at the side of the chair frame 4 is disposed in pivotal engagement therebetween by a threading rod, not shown. The pivotal adjustment of the angle of extension of the footrest 9 relative to the bottom of the seat 1 may be locked at a corner bracket 27 welded to the frame 25. The bracket 27 has two arms with transverse holes 28, which can be registered with a latching means fixed to the corresponding section in the side of the frame 4.

FIG. 3 shows the top surface of the foot massage unit 10 which gives the massage treatments to legs L through an upholstery omitted for clarity. It shows that the gear cases 14*a* and 14*b* are respectively attached to the frame 22 at the fastening means 23 and holding each side of the intermediate motor 12 at its upright rim sections 29.

Figure 4:
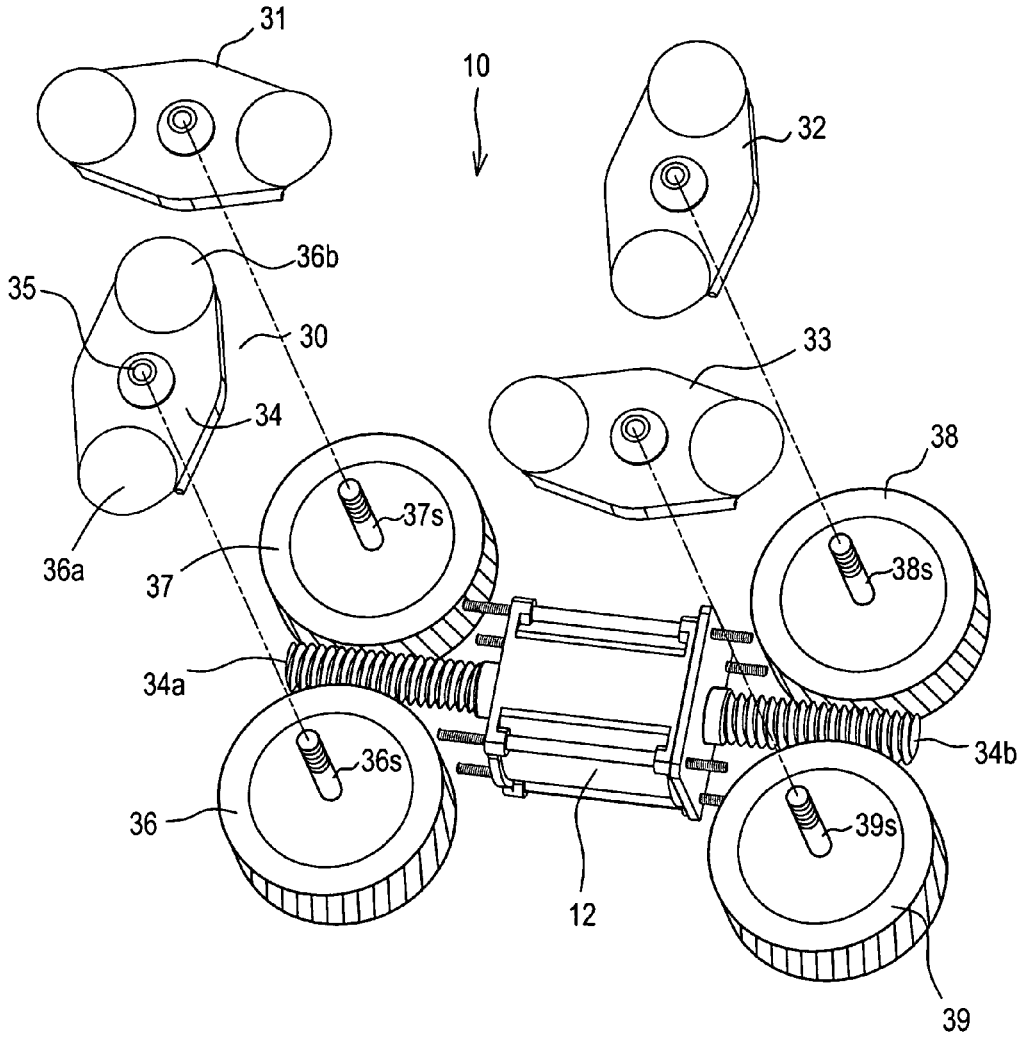
FIG. 4 is an exploded perspective view of the foot-massaging unit to illustrate the interior mechanism of motor driving four massaging heads simultaneously an alternate embodiment. Similar reference numbers denote corresponding features throughout the attached drawings.

Also referring to FIG. 4, the operation of the motor 12 to simultaneously drive four massaging heads 30 to 33 will be described. The driving shaft of the motor 12 extends in opposite directions and is provided with two concentric worms 34*a* and 34*b*. The worm 34*a* is in simultaneous mesh with two opposite side worm gears 36 and 37, which are centered about the respective shafts 36*s* and 37*s* held upright by the bottom and top cases 15*a* and 16*a* while the worm 34*b* is in mesh with worm gears 38 and 39 centered about the respective shafts 38*s* and 39*s*. The worms 34*a*/34*b* and warm gears 36 to 39 are all enclosed by the bottom and top gear cases 14*a* and 14*b*. Externally of the gear cases 14*a* and 14*b* are four rotating massage heads 30 to 33 fixed to the corresponding shafts 36*s* to 39*s*. The four massage heads are identical. For example, the head 30 comprises a diamond shaped elongated plate 34, a semispherical shaft bore 35 formed in the center of the plate 34, and two pressure balls 36*a* and 36*b* at the farther opposite tips of the elongated plate 34. The pressure balls 36*a*/36*b* are oversized so that their opposing spherical surfaces reach the sides of the leg, calf and/or foot wedged therebetween during the massaging operation whereby these leg areas receive a multifaceted stimulation of lateral as well as perpendicular elements which is important to achieve the unified drive system of the present invention. In addition, the worms and gears are meshed so that the gears in a set within a gear case rotate in opposite directions without interference, as will do the attached massage heads 30 to 33.

The massage chair 1 is operated by the uniform drive system utilizing a motor and the worm/gear drive for two-way or four-way massaging balls for each of the head, back and leg sections. Thus, the simplified structure with less moving parts to construct and maintain the footrest 10 of the present invention saves the massage chair from requiring the complex drive systems of conventional chair/rest combinations of the same kind and translates into a dramatically reduced cost while providing holistic massage benefits to more users. In case of maintenance as well as manufacturing, the back unit 6 and leg unit 10 are interchangeable with a simple switching of the respective frames which means reduced loss of resources in practice by encouraging immediate repairs against discarding the whole chair or footrest.

Therefore, while the presently preferred form of the massager footrest has been shown and described, and modifications thereof discussed, persons skilled in this art will readily appreciate that various additional changes and modifications may be made without departing from the spirit of the invention, as defined and differentiated by the following claims.

It is to be understood that the present invention is not limited to the sole embodiment describe above, but encompasses any and all embodiments within the scope of the following claims.

The invention claimed is:

1. A massage chair comprising:

a footrest massager with an upright support, a foldable seat frame connected to a top of the said upright support for holding a seatback and a seat bottom, a plurality of massaging units located in both the said footrest massager and the said seatback, said massaging units comprising an electrical motor with in-line opposite driving worms, two symmetrically shaped gear cases positioned transversely over the respective said driving worms of the motor, said gear cases having upper and lower twin gear housings, four worm gears, said worm gears paired opposite one another, said worm gears of each pair are opposite and in mesh with one of the respective said driving worms, said pairs of worm gears enclosed in each of the said gear cases, each respective said worm gears being centered about a gear shaft protruding upwardly from the gear cases, four rotating massage heads, each said rotating massage head fixed to the said gear shafts of the said worm gears external to the gear cases, said rotating massage heads of the said footrest provide massage with either substantially perpendicular pressure to a relatively flat body area or multi-directional pressure to narrower lower extremities of legs, calves and/or feet whereby said massaging units of the said footrest massager and said seatback are interchangeable and are equivalently sized.

2. The massage chair of claim 1, wherein:

each of the said massage heads have a diamond shaped elongated plate, a semispherical shaft bore formed in the center of the said elongated plate for a penetrating engagement with the said gear shaft, and two pressure balls located at the farther opposite tips of the said elongated plate, said pressure balls being oversized so that their opposing spherical surfaces reach the sides of the leg, calf and/or foot, with a multifaceted stimulation in lateral as well as perpendicular directions.

3. A massage chair comprising:

a floor base with an upright support, a foldable seat frame connected to a top of the upright support for holding a seatback and a seat bottom, said seatback containing a multitude of motorized massage units, said seatback is upholstered operatively against a user's upper body, a detachable footrest hinged to the seat frame at the front of the said seat frame near the said seat bottom, said footrest containing a multitude of motorized massage units of identical structure and massaging mechanisms to said multitude of motorized massage units contained in the said seatback, said footrest having two leg grooves and an inner space, said multitude of massage units located in said inner space, said massage units comprising an electrical motor with in-line opposite driving worms, two symmetrically shaped gear cases positioned transversely over the respective said driving worms of the motor, said gear cases having upper and lower twin gear housings, four worm gears, said worm gears paired opposite one another, said worm gears of each pair are opposite and in mesh with one of the respective said driving worms, said pairs of worm gears enclosed in each of the said gear cases, each respective said worm gears being centered about a gear shaft protruding upwardly from the gear cases, four rotating massage heads, each said rotating massage head fixed to the said gear shafts of the said worm gears external to the gear cases, said rotating massage heads of the said footrest provide massage with either substantially perpendicular pressure to a relatively flat body area or multi-directional pressure to narrower lower extremities of legs, calves and or feet.

4. The massage chair of claim 3, wherein:

each of the said massage heads have a diamond shaped elongated plate, a semispherical shaft bore formed in the center of the said elongated plate for a penetrating engagement with the said gear shaft, and two pressure balls located at the farther opposite tips of the said elongated plate, said pressure balls being oversized so that their opposing spherical surfaces reach the sides of the leg, calf and/or foot, with a multifaceted stimulation in lateral as well as perpendicular directions.

5. A massage chair comprising:

a floor base with an upright support, a foldable seat frame connect to a top of the upright support for holding a seatback and a seat bottom, said seatback containing at least one of a multitude of motorized massage units, said seatback upholstered operatively against a user's upper body, a footrest hinged to the seat frame at its front end near the said seat bottom, said footrest containing a multitude of motorized massage units of identical structure and massaging mechanisms and are interchangeable with said multitude of motorized massage units contained in the said seatback, said footrest having two leg grooves and an inner space, said multitude of massage units located in said inner space, said massage units comprising an electrical motor with in-line opposite driving worms, two symmetrically shaped gear cases positioned transversely over the respective said driving worms of the motor, said gear cases having upper and lower twin gear housings, four worm gears, said worm gears paired opposite one another, said worm gears of each pair are opposite and in mesh with one of the respective said driving worms, said pairs of worm gears enclosed in each of the said gear cases, each respective said worm gears being centered about a gear shaft protruding upwardly from the gear cases, four rotating massage heads, each said rotating massage head fixed to the said gear shafts of the said worm gears external to the gear cases, said rotating massage heads of the said footrest provide massage with either substantially perpendicular pressure to a relatively flat body area or multi-directional pressure to narrower lower extremities of legs, calves and or feet.

6. The massage chair of claim 5, wherein:

each of the said massage heads have a diamond shaped elongated plate, a semispherical shaft bore formed in the center of the said elongated plate for a penetrating engagement with the said gear shaft, and two pressure balls located at the farther opposite tips of the said elongated plate, said pressure balls being oversized so that their opposing spherical surfaces reach the sides of the leg, calf and/or foot, with a multifaceted stimulation in lateral as well as perpendicular directions.

* * * * *